US005285754A

United States Patent [19]

Bell

[11] Patent Number: 5,285,754

[45] Date of Patent: Feb. 15, 1994

[54] VALVE COVER ASSEMBLY FOR INTERNAL COMBUSTION ENGINES

[75] Inventor: Lawrence E. Bell, Kingston, N.H.

[73] Assignee: Freudenberg-NOK General Partnership, Plymouth, Mich.

[21] Appl. No.: 90,898

[22] Filed: Jul. 12, 1993

[51] Int. Cl.[5] ..... F01M 9/10

[52] U.S. Cl. ..... 123/90.38; 123/41.86; 123/195 C; 123/573; 123/196 M

[58] Field of Search ..... 123/90.38, 195 C, 196 M, 123/198 E, 41.86, 572, 573

[56] References Cited

U.S. PATENT DOCUMENTS

| | | | |
|---|---|---|---|
| 4,569,323 | 2/1986 | Okumura | 123/41.86 |
| 4,602,595 | 7/1986 | Aoki et al. | 123/90.38 |
| 4,790,287 | 12/1988 | Sakurai et al. | 123/573 |
| 4,958,613 | 9/1990 | Hiraoka et al. | 123/572 |
| 4,969,434 | 11/1990 | Nakagawa | 123/90.38 |
| 4,993,375 | 2/1991 | Akihiko | 123/90.38 |
| 5,058,542 | 10/1991 | Grayson et al. | 123/90.38 |
| 5,129,371 | 7/1992 | Rosalik, Jr. | 123/90.38 |

FOREIGN PATENT DOCUMENTS

| | | | |
|---|---|---|---|
| 179231 | 9/1985 | Japan | 123/90.38 |

*Primary Examiner*—E. Rollins Cross
*Assistant Examiner*—Weilun Lo
*Attorney, Agent, or Firm*—Dinnin & Dunn

[57] ABSTRACT

A one-piece valve cover product for use on an internal combustion engine having an engine cylinder head, said cover product including dome-like upper portion which acts as a cover over the cylinder head area of the engine, a peripheral flange portion adapted for sealing engagement to the cylinder head, a plurality of apertures through said flange portion through which a plurality of fasteners can be inserted to secure said cover product in sealing engagement to the cylinder head, said valve cover including in an upper portion thereof a molded or cast conduit passageway member formed as part of the valve cover itself, said passageway member extending inside the cover and being adapted to receive an air/oil vapor mixture associated with operation of the engine and to condense oil out of said air/oil mixture, at least one or more apertures located in a lower part of that passageway member to permit the oil droplets which are condensed, to drain back into the engine, and wherein said valve cover is formed from a high-temperature resistant molding or castable material.

13 Claims, 2 Drawing Sheets

VALVE COVER ASSEMBLY FOR INTERNAL COMBUSTION ENGINES

BACKGROUND OF THE INVENTION

This invention broadly relates to a new cover assembly for use with internal combustion engines, and method associated therewith.

In the past, the common technique of achieving air-/oil separation in an engine cover was to utilize an assembly of metallic components inside the cover to direct the air/oil mixture through a passageway. The passageway was designed to allow the oil to condense out of the air/oil vapor, through the system of metallic components, and then permitting the oil to drain back into the engine. The past design for such an air/oil separation system included the following: (a) sheet metal or die cast metal baffle plates were attached to the inside of the valve covers with a multitude of fasteners, rivets or the like. In addition, the prior design technology required sealants between the cover and the metal baffle plates to improve the efficiency of the air/oil separation. (b) Plastic baffle plates were also sometimes utilized and were attached to the inside of the covers with fasteners, adhesives, sealants, staking operations, or by ultrasonic or vibration welding methods. (c) Also, a combination of the above assembly techniques referred to in a) and b) were used, followed by attachment to the inside of the valve cover itself.

The above described methods of designing or constructing such valve covers were highly undesirable for the following reasons: 1) The assembly of the components used in the past added to the complexity of the cover assembly, thereby adding significant unnecessary cost. The added cost associated therewith can be broken down into the cost of designing those components, the cost for tooling those components, purchasing, quality control, and the required inventory of components; and most importantly, the labor cost to assemble those components in prior engine covers. 2) The integrity of the system was also dependent upon the robustness of the assembly. The potential for the assembly to separate from the cover under the operating conditions of the engine (for the life of the vehicle) did exist. Such a separation would potentially cause engine damage or engine failure. 3) The assembly of components in such prior covers does not add to the structural integrity of the cover in its intended functional usage in the automotive engine environment.

Accordingly, it is a primary object of this invention to overcome the disadvantages and problems associated with prior engine cover assemblies as described above.

Another object of the present invention is to provide a novel valve cover product for internal combustion engines which is economical to produce, lightweight, strong, and highly advantageous in actual usage conditions on an internal combustion engine.

Other objects, features and advantages of the present invention will become apparent from the subsequent description and the appended claims, taken in conjunction with the accompanying drawings.

SUMMARY OF THE INVENTION

Figure 1:
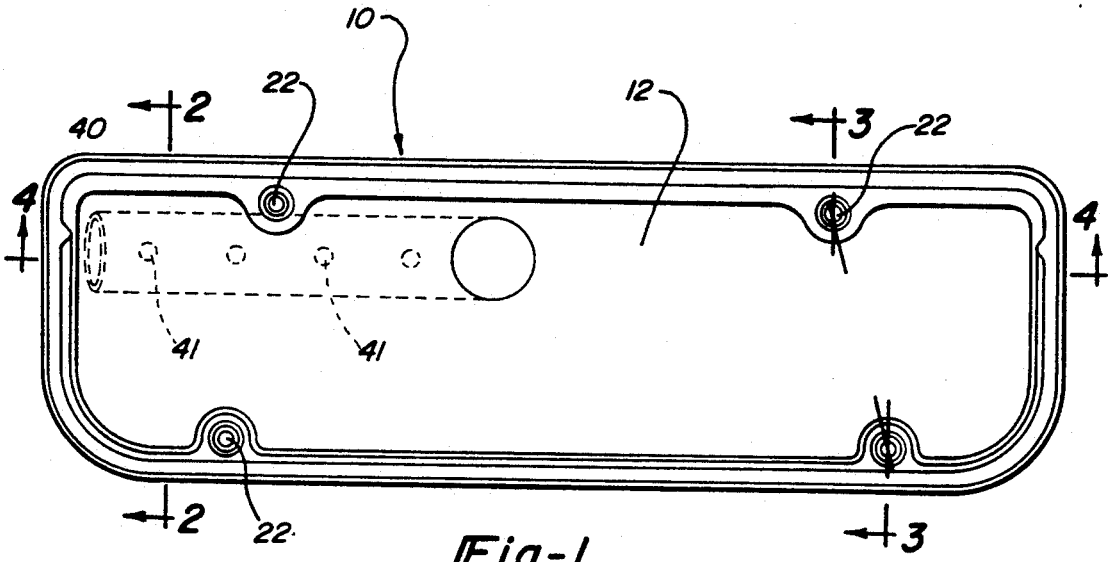
FIG. 1 is a bottom view of a valve cover for an internal combustion engine in accordance with the invention.

Briefly stated, from a product standpoint, this invention comprises a plastic cover product for use on an internal combustion engine having an engine cylinder head, said cover product including: a dome-like upper portion which acts as a cover over the cylinder head area of the engine, a peripheral flange portion adapted for sealing engagement to the cylinder head, a plurality of apertures through said flange portion through which a plurality of fasteners can be inserted to secure said cover product in sealing engagement to the cylinder head, a conduit passageway member formed as part of the plastic cover product, said member extending inside the cover, and being adapted to receive an air/oil mixture associated with operation of the engine and to condense oil out of the air/oil mixture, at least one or more apertures located in a lower part of the passageway member to permit the oil which is condensed to drain back into the engine, and wherein said cover product is formed from high temperature resistant material selected from at least one of the group consisting of a thermoplastic and a thermoset plastic material. Preferably the valve cover of the invention is of single-piece molded unitary plastic construction, although other slightly modified forms thereof may also be used. It should be noted that this invention is applicable to molded plastic valve covers and to die-cast (e.g., aluminum) valve covers; however, the desired technique is to use a moldable plastic to form the cover.

The present invention was made to overcome the problems and technical disadvantages associated with prior valve cover assemblies. It has been unexpectedly discovered, in accordance with this invention, that through the molding or casting of a passageway into a generally unitary or one-piece plastic valve cover, the following problems are solved:

a) The tooling costs of the numerous prior components are eliminated, thus significantly reducing the overall cost associated with manufacture of such engine valve covers.

b) The assembly of the past metallic (or other material baffle plate) components is eliminated, thereby significantly reducing labor costs.

c) The design, purchasing, quality control, and inventory costs are all significantly reduced, due to the low number of components required in accordance with this invention (i.e., essentially a one piece valve cover).

d) The design integrity, or robustness of the design, is enhanced due to the usage of a lessor number of components, which in the past had been prone to separation under the harshness of engine operating conditions, e.g. high temperature, exposure to fluids, and engine vibrational effects.

e) The structural integrity of the molded-in or cast-in air/oil separation engine cover is also improved, relative to prior designs. Thus the present engine cover of this invention provides a much more rigid cover system, and this improves the performance of the cover sealing system. In addition, the valve cover product in accordance with this invention allows for the cover to be redesigned with less material than the prior art technology ever permitted, thereby offering further cost reductions.

DESCRIPTION OF THE BEST MODE AND PREFERRED EMBODIMENTS

The valve cover of the invention is useable on numerous different types of internal combustion engines, such as for example V-6 engines, V-8 engines; and, 4-cylinder, 6-cylinder, and 8-cylinder engines of the straight line type. The valve cover is particularly suited for usage on V-6 or V-8 engines, however, it will be apparent to those skilled in the art that it is applicable to virtually any type of internal combustion engine.

Referring now to the drawings, wherein like reference numerals denote like or corresponding parts, there is shown in FIGS. 1-6 a valve cover product or valve cover assembly in accordance with the present invention.

Figure 2:
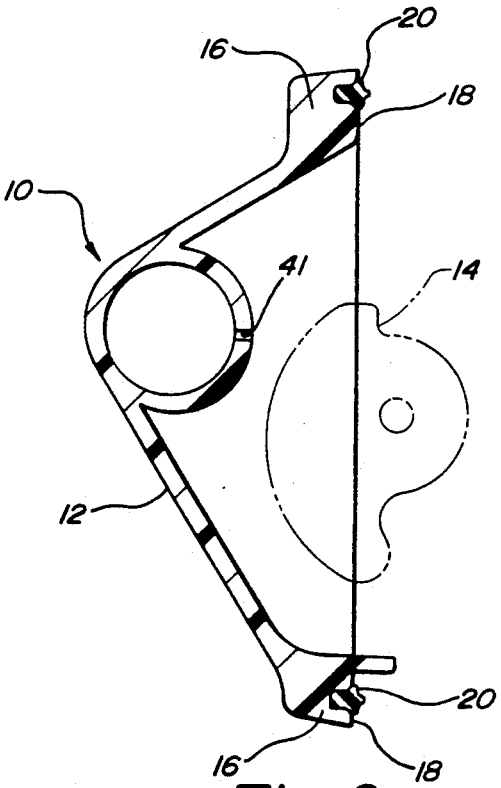
FIG. 2 is a sectional view taken along the line 2—2 in FIG. 1.
Figure 3:
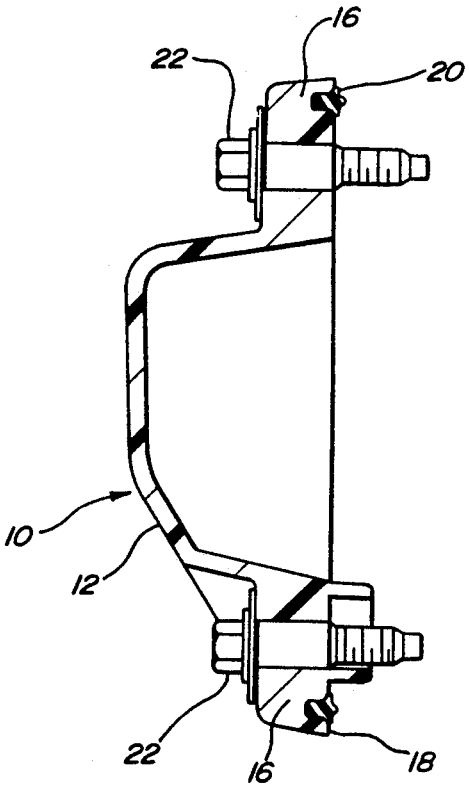
FIG. 3 is a sectional view taken along the line 3—3 in FIG. 1.

FIGS. 1, 2, and 3 show a valve cover product designated 10 in accordance with the invention. The cover 10 is comprised of a dome-like upper portion 12 which functions as a cover or shield over the rocker arm 14 shown in phantom lines in FIG. 2. The valve cover 10 is further comprised of a peripheral flange portion 16 (FIG. 2) which has a sealing surface 18 formed around the complete peripheral edge of the flange 16. In the sealing surface 18 there is commonly used a seal or gasket member 20, which functions to provide sealing engagement with the cylinder head of the engine when the valve cover 10 is secured to the cylinder head through usage of the multiple clamping members or fasteners designated 22 (see FIG. 1).

Figure 4:
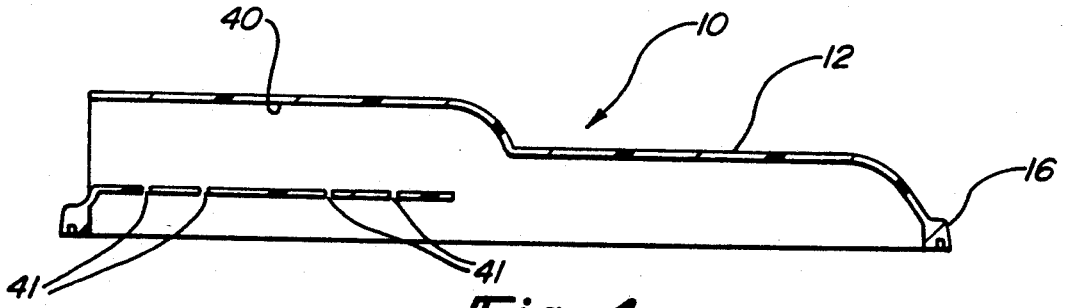
FIG. 4 is a sectional view taken along the line 4—4 in FIG. 1.

FIG. 4 illustrates a sectional view through the valve cover 10 of FIG. 1, in particular, FIG. 4 illustrates a tubular passageway member designated 40. As will be seen from FIGS. 1 and 4 the tubular passageway 40 is elongated and has holes or apertures 41 in the bottom thereof. Its purpose will be described in more detail below.

Figure 5:
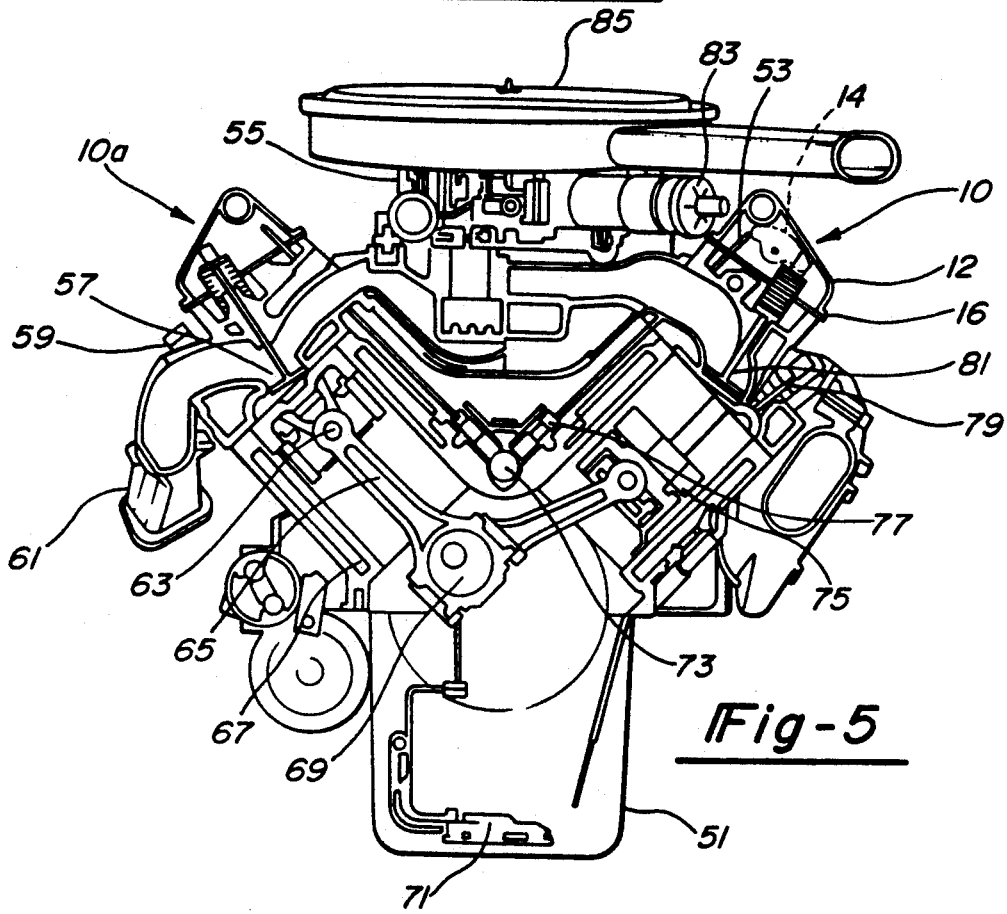
FIG. 5 is a general schematic view of an internal combustion engine showing the valve cover of FIG. 1 in position on the cylinder head of the engine.
Figure 6:
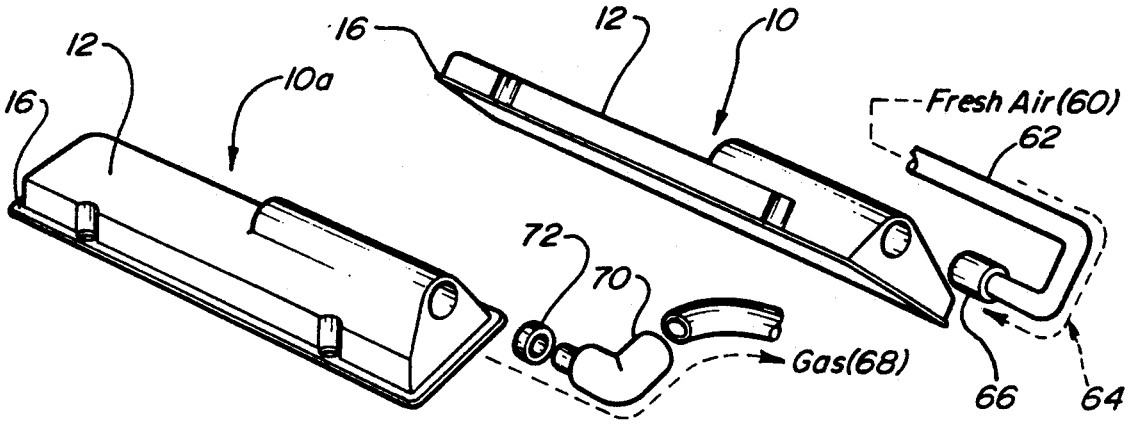
FIG. 6 is a general schematic view showing a right hand valve cover and left hand valve cover as they would be generally positioned on an automotive engine in accordance with the invention.

FIG. 5 illustrates general schematic view of a V-8 engine (partly in cross-section) having the valve cover 10 mounted on the right side thereof and a similar valve cover 10*a* mounted on the left side thereof (differing only in terms of left hand versus right hand construction-orientation). FIG. 6 illustrates the same right hand valve cover 10 and left hand cover 10*a*, in elevation diagram form, for purposes of illustrating, in example format, how the air and gas flow is directed through an automotive engine system utilizing the valve cover products of the invention as will be described in more detail below.

The operation of the valve cover in accordance with the invention is as follows. In essentially all automotive engine systems, i.e. of the internal combustion engine type (see FIG. 5), a system of circulating oil is used to lubricate the engine parts. The engine oil is normally accumulated in the oil pan area 51 of the engine, and from there the oil is circulated through various conduits and passageways (not shown) throughout the engine for purposes of lubricating same. A typical engine lubrication system, showing the various conduits and passageways for circulation of the oil, is shown for example in the "Motor's Auto Repair Manual", 40th edition, published 1977, at page 1-205, the disclosure of which is hereby incorporated herein by reference. A simplified traditional push rod style typical V-8 engine, as shown in the sectional view of FIG. 5, contains the components of the oil pan 51, the rocker arm 14, the push rod 53, the carburetor 55, the exhaust valve 57, the manifold heat control member 59, the exhaust manifold 61, the piston pin 63, a connecting rod 65, a water jacket 67, a crank shaft 69, an oil intake means 71, a cam shaft 73, a piston 75, a valve tappet 77, a spark plug 79, an intake valve 81, a spark coil 83, and an air intake 85. Note that this invention is equally applicable to other cylinder head configurations, such as overhead cam engines or the like.

Under normal engine operating conditions there is a vaporous mixture of gases which forms in various parts of the engine due to splashing action of the oil, but which also may contain contaminants such as unburned fuel, etc. It is highly desirable to provide a technique to burn those contaminants in the combustion process, while allowing the oil in the vapor mixture to condense out of same, and then drain back into the engine itself. The accepted practice is to introduce fresh air through the system and then separate the contaminants from the oil, vapor mixture, and burn the contaminants in the combustion process. In the novel construction developed in this invention, this condensation of oil out of the air/oil vapor mixture is caused to occur when the air/oil vapor passes through the tubular conduit portion designated 40, wherein due to the concentration of the air/oil vapor mixture within tube 40, and the flow rate of said mixture, the oil within the mixture is caused to condense. The condensed droplets of oil then pass through the apertures or holes designated 41, which are formed at the bottom portion of the tubular member 40. The condensed oil droplets then drain back into the engine proper itself through various passageways which are included in the automotive engine system for purposes of permitting the circulating oil to drain and gather at the bottom of the engine in the oil pan area 51.

As shown in FIG. 6, a small but effective amount of fresh air 60 is seen to be entering a conduit 62 which leads the air into the valve cover 10 in the direction shown by dotted line 64. The fresh air is from a source such as the air intake 85 of the engine (FIG. 5). The conduit 62 for the fresh air is connected to the valve cover 10 through the use of a suitable grommet means designated 66 which connects the conduit 62 to the valve cover 10. Gas or vapor within the upper portion of the engine, after having the oil droplets condensed out of same in the tubular members 40, then is allowed to pass out as a gas 68 through the PCV (Positive Crankcase Ventilation) valve designated 70 as the gas exits from the valve cover 10*a* shown in FIG. 6. The PCV valve 70 is connected to the valve cover 10*a* through the device of a suitable grommet means designated 72. The gas which exits valve cover 10*a* is then re-circulated to the combustion process of the engine, and this technique provides for keeping the engine as environmentally clean as possible, and preventing detrimental engine vapors from escaping into the atmosphere.

As seen in particular from FIG. 1 or FIG. 4, the tubular passageway 40 includes one or more apertures 41 located in the lower part of the passageway, and the tube member 40 permits the oil to be condensed from the air/oil mixture, and then it is drained back into the engine and/or oil pan section 51 of the automotive engine.

The novel valve cover product 10 is preferably formed, for example by molding or casting, from a high temperature resistant material selected from the group consisting of a thermoplastic and/or a thermoset plastic material. More particularly this material is preferably selected from the group consisting of a thermoplastic nylon material or a thermoset polyester material. Best results are obtained using a thermoplastic material such as Nylon 6/6 (available from companies such as BASF Corp. or DuPont Corp.), or using a thermoset plastic material such as Cyglas No. 685, a polyester material (available from American Cyanamid Corp.).

While it will be apparent that the preferred embodiments of the invention disclosed are well calculated to fulfill the objects, benefits, and/or advantages of the invention, it will be appreciated that the invention is susceptible to modification, variation and change without departing from the proper scope or fair meaning of the subjoined claims.

What is claimed is:

1. A one-piece molded or cast cover product for use on an internal combustion engine having an engine cylinder head and a plurality of valve-rocker arms, said cover product including:

an elongated dome-like upper portion which acts as a cover over the rocker arm and cylinder head area of the engine, a peripheral flange portion adapted for sealing engagement to the cylinder head through the use of a seal gasket member, a plurality of apertures through said flange portion through which a plurality of fasteners can be inserted to secure said cover product in sealing engagement to the cylinder head, a conduit passageway member formed as part of the one-piece plastic cover product, said member extending inside the cover, and being adapted to receive an air/oil mixture associated with operation of the engine and to condense oil out of the air/oil mixture, at least one or more apertures located in a lower part of the passageway member to permit the oil which is condensed to drain back into the engine

2. The invention of claim 1 further characterized as including, a first and second said cover products being mounted on left and right side cylinder heads of the engine, a first tubular conduit connected to the passageway member of the first cover product for introducing a small amount of fresh air thereto from an air intake member on the engine, and a second tubular conduit connected to the passageway member of the second cover product to transmit exit gas therefrom back through the combustion zone of the engine.

3. The invention of claim 1 wherein, said cover product is formed from a high temperature resistant material selected from the group consisting of a thermoplastic and thermoset plastic material.

4. The invention of claim 3 wherein, said material is selected from the group consisting of a thermoplastic nylon or a thermoset polyester material.

5. The invention of claim 2 wherein, said cover product is formed from a high temperature resistant material selected from the group consisting of a thermoplastic and thermoset plastic material.

6. The invention of claim 5 wherein, said material is selected from the group consisting of a thermoplastic nylon or a thermoset polyester material.

7. A one-piece plastic cover product, suitable for use on an internal combustion engine having an engine cylinder head, said cover product including:

a dome-like upper portion which acts as a cover over the cylinder head area of the engine, a peripheral flange portion adapted for sealing engagement to the cylinder head, a plurality of apertures through said flange portion through which a plurality of fasteners can be inserted to secure said cover product in sealing engagement to the cylinder head, a conduit passageway member formed as part of the one-piece plastic cover product, said member extending inside the cover, and being adapted to receive an air/oil mixture associated with operation of the engine and to condense oil out of the air/oil mixture, at least one or more apertures located in a lower part of the passageway member to permit the oil which is condensed to drain back into the engine, and wherein said cover product is formed from high temperature resistant material selected from at least one of the group consisting of a thermoplastic and a thermoset plastic material.

8. The invention of claim 7 further characterized as including, a first and second said cover products being mounted on left and right side cylinder heads of the engine, a first tubular conduit connected to the passageway member of the first cover product for introducing a small amount of air thereto from an air intake member of the engine, and a second tubular conduit connected to the passageway member of the second cover product to transmit exit gas therefrom back through the combustion zone of the engine.

9. The invention of claim 7 wherein, said material is selected from the group consisting of a thermoplastic nylon or a thermoset polyester material.

10. The invention of claim 8 wherein, said material is selected from the group consisting of a thermoplastic nylon or a thermoset polyester material.

11. A method of separating oil from an air/oil vapor mixture in an internal combustion engine, comprising the steps of:

providing a one-piece molded or cast valve cover product which is positioned in sealing engagement to cover the cylinder head area of the engine, said cover product including a peripheral flange portion adapted for sealing engagement to the cylinder head through use of a seal gasket member, and a conduit-like passageway formed as an integral part of the one-piece molded or cast valve cover product in an upper portion thereof relative to the engine cylinder head, and at least one or more apertures formed in a lower part of said passageway, allowing the air/oil vapor mixture to pass into said conduit-like passageway and thereby condensing oil out of the air/oil mixture to permit the oil which is condensed to drain back through said apertures into a lower part of the engine.

12. The method of claim 11 wherein, said cover product is formed from a high temperature resistant material selected from the group consisting of a thermoplastic and thermoset plastic material.

13. The method of claim 12 wherein, said material is selected from the group consisting of a thermoplastic nylon or a thermoset polyester material.

* * * * *